United States Patent [19]

Hogenson

[11] Patent Number: 5,072,517

[45] Date of Patent: Dec. 17, 1991

[54] APPARATUS FOR RETAINING A TWO-PIECE CONNECTOR FOR ATTACHMENT TO A FLAT MULTICONDUCTOR ELECTRICAL CABLE

[75] Inventor: Raymond A. Hogenson, Austin, Tex.

[73] Assignee: Minnesota Mining and Manufacturing Company, St. Paul, Minn.

[21] Appl. No.: 711,194

[22] Filed: Jun. 6, 1991

[51] Int. Cl.[5] ..... H01R 43/04

[52] U.S. Cl. ..... 29/749; 29/753; 29/759

[58] Field of Search ..... 29/749, 751, 753, 759, 29/760, 861

[56] References Cited

U.S. PATENT DOCUMENTS

| | | | |
|---|---|---|---|
| 4,580,340 | 4/1986 | Shields | 29/861 |
| 4,641,427 | 2/1987 | Shields | 29/857 |
| 4,709,473 | 12/1987 | Shields | 29/749 |
| 4,744,142 | 5/1988 | Shields | 29/749 |
| 4,765,059 | 8/1988 | Pearce | 29/749 |

*Primary Examiner*—Carl E. Hall

*Attorney, Agent, or Firm*—Gary L. Griswold; Walter N. Kirn; David W. Anderson

[57] ABSTRACT

Electrical connector attachment tooling for attaching an electrical connector to a flat, multiconductor cable includes leaf springs, cam-actuated gripping means for locating and retaining the connector in proper relationship to the cable.

10 Claims, 3 Drawing Sheets

APPARATUS FOR RETAINING A TWO-PIECE CONNECTOR FOR ATTACHMENT TO A FLAT MULTICONDUCTOR ELECTRICAL CABLE

BACKGROUND OF THE INVENTION

1. Field Of The Invention

The present invention relates generally to machines for automatically attaching two-piece electrical connectors to flat, multiconductor electrical cable, and particularly to tooling within the machine for gripping the connectors prior to attachment to the cable.

2. Description Of The Prior Art

In the electronics industry and computer field, and particularly in the field of minicomputers and microcomputers, it is necessary to utilize multiple lines or busses interconnecting several different elements on the same line. For example, it may be necessary to have a sixteen conductor cable for providing a sixteen conductor bus for communicating between a central data processing unit, a peripheral memory, and peripheral data monitoring devices. As a consequence, more and more reliance is placed on mass termination techniques for interconnections between and among components.

Typically, such a mass termination system includes the use of multiple conductor cable which is usually a flat cable having a plurality of conductors in a parallel, standardized spaced array in the cable and embedded on or surrounded by flexible plastic insulating material. For particular assemblies which are produced in substantial quantities, large amounts of multiconductor cable are required, all having a precise length and having two or more connectors disposed at precise locations along each cable length, with at least one connector located at each end of the cable. In a typical application, the various connectors may be of different configurations for interfacing with different types or makes of equipment.

The connectors are usually produced in two mating pieces, and are adapted to be applied with the cable "sandwiched" between the connector halves. One connector half has an elongate slot therein, and within the connector area, a plurality of spaced apart contacting pins. These pins are spaced apart the same distance that the conductors in the cable are spaced from each other. Also, the first pin is spaced a predetermined distance from one edge of the slot in the connector. When the connector half is properly positioned adjacent the cable, the connector half is forced against the cable to press the connector pins through the plastic cable layer and into contact with the individual conductors in the cable. The copper conductor is captured by the pins without the pins contacting conductors other than the one with which the pins are aligned.

U.S. Pat. No. 4,580,340 is a seminal patent in this field and describes a machine in which cable is fed from a reel to a cable assembly or connector applying station. Each station includes a pair of connector feed devices or magazines, connector receiving tooling and pneumatic rams for moving the tooling between a retracted connector-receiving position and an extended staking or terminating position.

The above patent and U.S. Pat. Nos. 4,641,427; 4,709,473 and 4,744,142 all illustrate machines in which the tooling comprising the connector applying station is provided with a recess to accept the connector halves. This recess is by necessity larger than the connector, and, as a result, there is some room for the connector halves to move relative to the cable as the connector halves are applied. The goals of this invention are to eliminate any relative movement between the connector and the tooling and positively position the connector halves through application to the cable.

SUMMARY OF THE INVENTION

The present invention accomplishes the goals of positively positioning the connector halves prior to and during attachment of the connectors to the cable by providing connector receiving and attachment tooling which includes two opposed bases disposed one on each side of the cable, with at least one of the bases moveable relative to and toward the other to grip the cable to which the connector is to be applied. Supported on the bases are two strikers which are moveable relative to each other and the bases which support them. Connector halves are supported by each base, with a connector half disposed in front of each striker, i.e., between each striker and the cable. Each striker includes gripper means disposed at each end of the striker which grip each connector half as the striker is pushed toward the cable. The gripper means is preferably a formed leaf spring attached to each end of the striker which spring does not contact the connector half when the striker is in a retracted position. The bases are provided with a camming surface which is positioned to engage the gripper springs as the strikers move forward from the retracted position toward the cable and force the springs into contact with both ends of each connector half. In this manner, the connector halves are positively contacted and captured, and thus precisely located with respect to the cable.

BRIEF DESCRIPTION OF THE DRAWINGS

The present invention will be more precisely described with reference to the accompanying drawing, wherein like numbers refer to like parts in the several views, and wherein.

DESCRIPTION OF THE PREFERRED EMBODIMENTS

Figure 1:
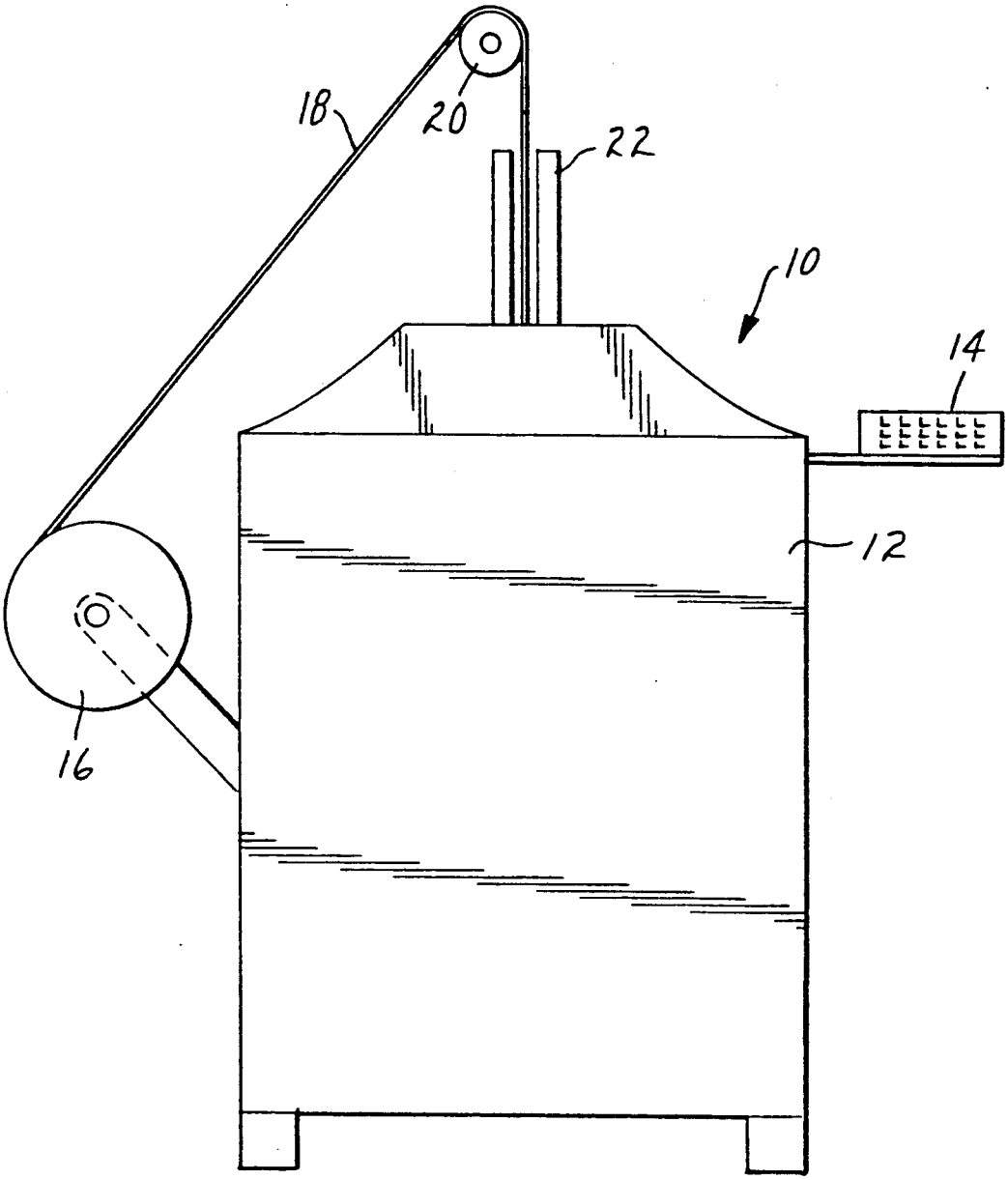
FIG. 1 is a schematic, front elevational view of a connector-applying machine in which the present invention is located.

With reference to FIG. 1, the present invention is intended to be included as a mechanism within a connector-to-cable applying machine generally designated as 10, although it is contemplated that the present invention could be utilized independently, apart from the machine 10 described. The machine 10 comprises a housing 12, a control panel 14 and a supply reel 16 of flat, multiconductor cable 18. The cable 18 is directed by a wheel 20 through a guide 22 into the machine 10. As may be seen in FIGS. 2 and 3, the machine 10 houses a connector application station, which includes two opposed sets of connector application tooling 26 and 28.

Figure 2:
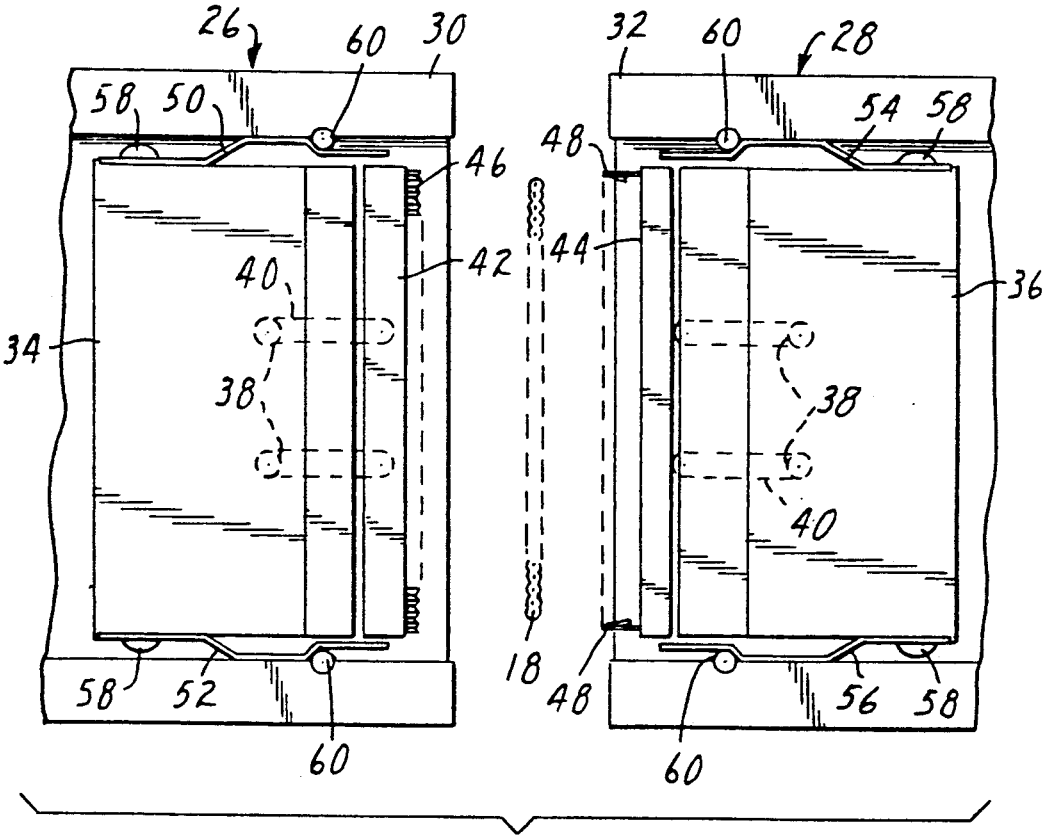
FIG. 2 is a top, plan view of the connector applying tooling of the present invention located within the machine of FIG. 1 with the tooling in a position to receive a connector.

Each set of tooling 26 and 28 includes a base 30 and 32 and a striker 34 and 36. The bases 30 and 32 are mounted to be moveable toward the cable 18 by any conventional means such as air or hydraulically powered rams, mechanical levers, cams or the like. FIG. 2 shows the bases 30 and 32 and the strikers 34 and 36 in retracted positions to which each is returned after an operating cycle by any conventional means such as springs.

The strikers 34 and 36 overlie the bases 30 and 32, respectively, and are connected by means of pins 38 and slots 40. The pins 38 may extend from either the bases 30 and 32 or the strikers 34 and 36, with the slots being located in the other. In the embodiment shown, the pins 38 extend from the strikers 34 and 36, with the slots being located in the bases 30 and 32. The pins 38 and slots 40 maintain the strikers 34 and 36 in alignment with the bases 30 and 32, while allowing the strikers 34 and 36 to move relative to the bases 30 and 32 in a direction normal to the plane defined by the cable 18 as it is shown in FIG. 2.

Figure 3:
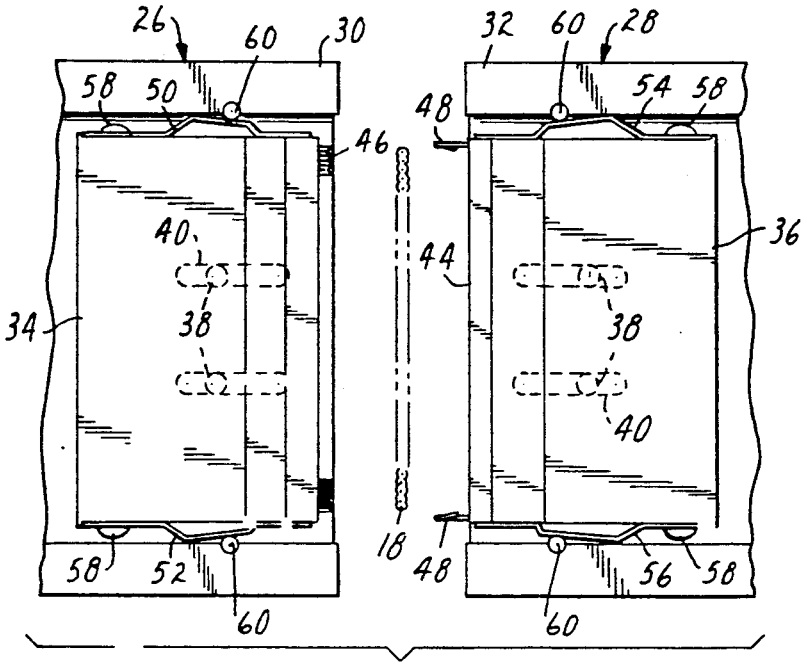
FIG. 3 is a top, plan view of the connector applying tooling of the present invention located within the machine of FIG. 1 with the tooling in a position to apply a connector.

In the retracted positions shown in FIGS. 2 and 3, the strikers 34 and 36 are recessed a distance from the edges of the bases 32 and 34 to allow room for the placement of connector halves 42 and 44. The connector halves 42 and 44 are designed to automatically form an electrical connection with the cable 18 when the connector halves 42 and 44 are aligned with the cable 18 and pressed together to engage the cable 18. Typically, one connector half (connector half 42 as illustrated) includes contact pins 46 which are spaced equally with the spacing of the conductors of the cable 18 and cut through the insulation of the cable 18 to engage the conductors. The remaining connector half 44 mates with the first connector half 42 and includes latches 48 to retain the connector half 44 in contact with the connector half 42 and maintain the cable 18 engaged with the connector half 42.

The connector halves 42 and 44 may be and are typically conveyed to the bases 30 and 32 by a magazine which drops a new set of connector halves 42 and 44 to the connector-application tooling 26 and 28 after the strikers 34 and 36 retract to the positions shown in FIG. 2. Of course, connector halves 42 and 44 may be placed in position by any suitable means, including manual placement.

Once loaded, the connector halves 42 and 44 are free to move from side to side a slight amount. This freedom is necessary to compensate for such things as misalignment of the feed magazine, tolerances of the connector halves, and similar circumstances which might result in size variations of the connector halves 42 and 44 or misalignment or misplacement of the connector halves 42 and 44 relative to the application tooling 26 and 28. However, such freedom of movement would be detrimental to the formation of a successful connection between the connector halves 42 and 44 and the cable 18. To positively align the connector halves 42 and 44 and the cable 18, and to securely maintain the connector halves 42 and 44 in this alignment, the connector-application tooling 26 and 28 is provided with a gripping means comprising four formed leaf springs 50, 52, 54 and 56.

The springs 50-56 are attached one to each end of each of the strikers 34 and 36 by, for example, pins 58. Any other suitable fastener or fastening means such as welding may be employed. The springs 50-56 are resilient and are biased by their resilience to the position illustrated in FIG. 2, that is, the springs are designed to have their ends spread away from the strikers 34 and 36 when the strikers 34 and 36 are fully retracted as shown in FIG. 2. This position of the springs 50-56 allows room between the springs for the placement of the connector halves 42 and 44 without interference.

As the strikers 34 and 36 are moved forward toward the cable 18 relative to the bases 30 and 32, the springs 50-56 contact a camming surface such as that formed by the pins 60 in FIGS. 2 and 3. The resulting camming action forces the free ends of the springs 50-56 inwardly toward the strikers 34 and 36 and the connector halves 42 and 44. The springs 50-56 are designed to extend beyond the ends of the strikers 34 and 36 to enable contact between the springs 50-56 and the connector halves 42 and 44, and the strikers 34 and 36 are sized slightly narrower than the length of the connector halves 42 and 44 to ensure engagement between the springs 50-56 and the connector halves 42 and 44. Thus the connector halves 42 and 44 are positively gripped, while any tolerance variations of the connector halves 42 and 44 will be compensated for by the resiliency of the springs 50-56 and any misplacement of the connector halves 42 and 44 will be corrected since the springs 50-56 will move the connector halves 42 and 44 to the position shown in FIG. 3.

Figure 4:
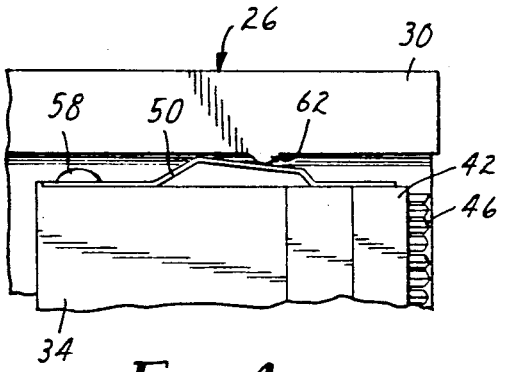
FIG. 4 is a partial plan view of an alternate embodiment of the present invention.

FIG. 4 illustrates that the camming surface provided by the pins 60 may be provided by other means, such as a machined surface 62 as shown. The camming surface may assume many other shapes, as will be apparent to one skilled in the art, so long as it is effective to force the springs 50-56 toward the connector halves 42 and 44 as the strikers 34 and 36 move toward the cable 18 relative to the bases 30 and 32.

In operation to attach a connector of two halves 42 and 44 to a cable 18, the cable 18 is first fed into the machine 10 to the position shown in FIGS. 2 and 3. Initially, the connector application tooling 26 and 28 is in the position shown in FIG. 2, with the strikers 34 and 36 fully retracted relative to the bases 30 and 32 and the springs 50-56 fully spread away from the strikers 34 and 36 as a result of lack of contact between the springs 50-56 and the camming surface 60 or 62. Upon actuation of the machine to attach the connector halves 42 and 44 to the cable 18, the strikers 34 and 36 are moved relative to the bases 32 and 34 to engage the springs 50-56 with the connector halves 42 and 44, as shown in FIG. 3, and the bases 30 and 32 are moved toward the cable 18 until the bases 30 and 32 contact and capture the cable 18. Once the cable 18 is captured, the strikers are extended fully to force the connector halves 42 and 44 fully into engagement with the cable 18.

In operation there may be some variation in the sequence of operation without affecting the ability of the machine 10 to attach the connector halves 42 and 44 to the cable 18 or the quality of attachment of the connector halves 42 and 44 to the cable 18. For example, one sequence would be to have the bases 30 and 32 extend fully to contact the cable 18 before any movement of the strikers 34 and 36 takes place. The strikers 34 and 36 would then extend from the position relative to the bases 30 and 32 shown in FIG. 2 to full extension after movement of the bases 30 and 32 has ceased. Another sequence is that shown in FIGS. 2 and 3 wherein the strikers 34 and 36 extend partially to capture the connector halves 42 and 44 before the bases 30 and 32 extend to capture the cable 18. The portion of the sequence which must be observed, however, is that the bases 30 and 32 must extend to capture the cable 18 before the strikers 34 and 36 extend fully to force the connector halves 42 and 44 onto the cable 18.

I claim:

1. Tooling for receiving and attaching a two-part electrical connector to a flat, multiconductor cable, including:

two opposed bases one on each side of the cable, with at least one of said bases being movable toward the other of said bases and said cable to contact and grip the cable between said bases;

two strikers supported one on each of said bases and movable relative to said bases toward each other and the cable, said strikers being movable between a retracted position wherein one part of the two-part electrical connector may be located on each of said bases between said strikers and the cable and an extended position wherein said strikers force the connector parts against the cable;

gripper means attached to each of said strikers for gripping the connector parts prior to attachment of the connector parts to the cable, said gripper means being free of contact with the connector parts when said strikers are in said retracted position; and camming means on said bases for contacting said gripper means as said strikers move from said retracted position toward said extended positions and for forcing said gripper means into contact with the connector parts.

2. The tooling according to claim 1 wherein said gripper means includes two formed leaf springs attached to each of said strikers and disposed to grip one of the connector parts between said two leaf springs when said camming means forces said springs toward said connector part.

3. The tooling according to claim 2 wherein said camming means comprises projections extending from said bases toward said strikers and disposed in the path of said springs as said strikers move from said retracted positions toward said extended positions.

4. The tooling according to claim 3 wherein said projections are formed integrally with said bases.

5. The tooling according to claim 3 wherein said projections are pins extending from said bases.

6. In a machine for applying two-part electrical connectors to a flat, multiconductor electrical cable, the machine including a connector application station and means for feeding the cable to the connector application station, the improvement including tooling located at the connector application station which comprises:

two opposed bases one on each side of the cable, with at least one of said bases being movable toward the other of said bases and said cable to contact and grip the cable between said bases;

two strikers supported one on each of said bases and movable relative to said bases toward each other and the cable, said strikers being movable between a retracted position wherein one part of the two-part electrical connector may be located on each of said bases between said strikers and the cable and an extended position wherein said strikers force the connector parts against the cable;

gripper means attached to each of said strikers for gripping the connector parts prior to attachment of the connector parts to the cable, said gripper means being free of contact with the connector parts when said strikers are in said retracted position; and camming means on said bases for contacting said gripper means as said strikers move from said retracted position toward said extended positions and for forcing said gripper means into contact with the connector parts.

7. The machine according to claim 6 wherein said gripper means includes two formed leaf springs attached to each of said strikers and disposed to grip one of the connector parts between said two leaf springs when said camming means forces said springs toward said connector part.

8. The machine according to claim 7 wherein said camming means comprises projections extending from said bases toward said strikers and disposed in the path of said springs as said strikers move from said retracted positions toward said extended positions.

9. The machine according to claim 8 wherein said projections are formed integrally with said bases.

10. The machine according to claim 8 wherein said projections are pins extending from said bases.

* * * * *